US011286748B2

(12) United States Patent
Romer et al.

(10) Patent No.: US 11,286,748 B2
(45) Date of Patent: Mar. 29, 2022

(54) PUMP-THROUGH STANDING VALVES, WELLS INCLUDING THE PUMP-THROUGH STANDING VALVES, AND METHODS OF DEPLOYING A DOWNHOLE DEVICE

(71) Applicants: Michael C. Romer, The Woodlands, TX (US); Randy C. Tolman, Spring, TX (US)

(72) Inventors: Michael C. Romer, The Woodlands, TX (US); Randy C. Tolman, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 318 days.

(21) Appl. No.: 15/723,739

(22) Filed: Oct. 3, 2017

(65) Prior Publication Data

US 2018/0135383 A1 May 17, 2018

Related U.S. Application Data

(60) Provisional application No. 62/422,303, filed on Nov. 15, 2016.

(51) Int. Cl.

| | |
|---|---|
| ***E21B 34/08*** | (2006.01) |
| ***E21B 34/10*** | (2006.01) |
| ***E21B 23/10*** | (2006.01) |

(52) U.S. Cl.

CPC ..... *E21B 34/10* (2013.01); *E21B 23/10* (2013.01); *E21B 2200/05* (2020.05)

(58) Field of Classification Search

CPC ..... E21B 34/06; E21B 34/10; E21B 34/08

See application file for complete search history.

(56) References Cited

U.S. PATENT DOCUMENTS 3,189,099 A * 6/1965 Ottemau ..... E21B 33/035 166/368
3,410,346 A * 11/1968 Garrett ..... E21B 34/105 166/53
3,827,501 A * 8/1974 Johnson ..... E21B 34/08 166/374

(Continued)

FOREIGN PATENT DOCUMENTS

EP 2 077 374 A1 7/2009
GB 2 393 747 A 4/2004

(Continued)

*Primary Examiner* — Kipp C Wallace

(74) *Attorney, Agent, or Firm* — Leandro Arechederra, III

(57) ABSTRACT

Pump-through standing valves, wells including the pump-through standing valves, and methods of utilizing a pump-through standing valve to deploy a downhole device are disclosed herein. The pump-through standing valves include a valve body, a standing valve at least partially formed within the valve body, and a flow-through valve at least partially formed within the valve body. The standing valve includes a standing valve fluid conduit and a standing valve flow control device. The flow-through valve includes a flow-through valve fluid conduit and a flow-through valve flow control device. The wells include a wellbore, which extends within a subterranean formation, a wellbore tubular, which extends within the wellbore, and the pump-through standing valve, which is operatively attached to the wellbore tubular.

18 Claims, 5 Drawing Sheets

(56) References Cited

U.S. PATENT DOCUMENTS 3,941,511 A * 3/1976 Morgan ..... E21B 43/121 417/57
5,207,897 A * 5/1993 Baird ..... B01D 17/0214 166/265
6,017,198 A 1/2000 Traylor et al.
6,250,387 B1 * 6/2001 Carmichael ..... E21B 37/00 166/311
6,328,102 B1 12/2001 Dean
6,354,378 B1 * 3/2002 Patel ..... E21B 21/103 166/321
7,111,675 B2 9/2006 Zisk, Jr.
7,322,803 B2 1/2008 Vogeley
7,484,940 B2 2/2009 O'Niell
7,597,150 B2 10/2009 Clem
8,133,041 B2 3/2012 Ludlow et al.
8,220,533 B2 7/2012 Longfield et al.
8,261,838 B2 * 9/2012 Bullen ..... E21B 43/129 166/372
8,511,390 B2 8/2013 Coyle et al.
9,322,239 B2 4/2016 Angeles Boza et al.
9,790,762 B2 10/2017 Tolman et al.
9,863,222 B2 1/2018 Morrow et al.
9,869,164 B2 1/2018 Tolman et al.
9,945,208 B2 4/2018 Tolman et al.
9,976,399 B2 5/2018 Tolman et al.
10,012,059 B2 7/2018 Romer et al.
10,018,021 B2 7/2018 Romer et al.
10,030,489 B2 7/2018 Romer et al.
10,030,508 B2 7/2018 Romer et al.
10,087,719 B2 10/2018 Tolman et al.
10,132,143 B2 11/2018 Romer et al.
10,138,713 B2 11/2018 Tolman et al.
10,221,639 B2 3/2019 Romer et al.
10,221,663 B2 3/2019 Romer et al.
10,309,195 B2 6/2019 Tolman et al.
10,352,130 B2 7/2019 Tolman et al.
10,358,896 B2 7/2019 Tolman et al.
10,443,370 B2 10/2019 Wang et al.
10,450,848 B2 10/2019 Wang et al.
10,697,287 B2 6/2020 Romer et al.
2002/0197174 A1 12/2002 Howard
2003/0010491 A1 1/2003 Collette
2006/0198742 A1 9/2006 DiFoggio et al.
2007/0114038 A1 * 5/2007 Daniels ..... E21B 43/122 166/372
2008/0003118 A1 1/2008 Traylor et al.
2008/0080991 A1 4/2008 Yuratich et al.
2009/0183879 A1 7/2009 Cox
2009/0218091 A1 9/2009 Dotson
2010/0012313 A1 1/2010 Longfield
2010/0206549 A1 * 8/2010 Dowling ..... E21B 43/126 166/105
2010/0211226 A1 8/2010 Dowling et al.
2010/0300701 A1 * 12/2010 Bullen ..... E21B 43/129 166/372
2011/0297393 A1 * 12/2011 Patel ..... E21B 34/06 166/373
2011/0311374 A1 12/2011 Ocalan et al.
2012/0006563 A1 * 1/2012 Patel ..... E21B 23/03 166/373
2012/0023606 A1 10/2012 Bouldin et al.
2017/0183945 A1 6/2017 Tolman et al.
2017/0183946 A1 6/2017 Tolman et al.
2018/0030812 A1 * 2/2018 Ning ..... E21B 43/12

FOREIGN PATENT DOCUMENTS

GB 2 403 752 A 1/2005
WO WO 01/20126 A2 3/2001
WO WO 2009/077714 6/2009
WO WO 2011/079218 A2 6/2011

* cited by examiner

PUMP-THROUGH STANDING VALVES, WELLS INCLUDING THE PUMP-THROUGH STANDING VALVES, AND METHODS OF DEPLOYING A DOWNHOLE DEVICE

CROSS REFERENCE TO RELATED APPLICATION

This application claims the benefit of U.S. Provisional Application Ser. No. 62/422,303, filed Nov. 15, 2016, entitled "Pump-Through Standing Valves, Wells Including the Pump-Through Standing Valves, and Methods of Deploying a Downhole Device," the disclosure of which is incorporated herein by reference in its entirety.

FIELD OF THE DISCLOSURE

The present disclosure is directed generally to pump-through standing valves, to wells including pump-through standing valves, and/or to methods of utilizing a pump-through standing valve to deploy a downhole device.

BACKGROUND OF THE DISCLOSURE

Wells, such as hydrocarbon wells, include a wellbore that extends within a subterranean formation. Such wells also may include a wellbore tubular, such as a casing string and/or a tubing string, that extends within the wellbore and defines a tubular conduit. Under certain conditions, a downhole, or toe, end of the wellbore tubular includes, is associated with, and/or has attached thereto a standing valve. The standing valve is configured to permit a fluid inflow from the wellbore into the tubular conduit and also to resist a fluid outflow from the tubular conduit into the subterranean formation. Such a configuration may facilitate production of a reservoir fluid, such as a hydrocarbon, from the subterranean formation while, at the same time, retaining the reservoir fluid within the tubular conduit under conditions in which a pressure within the tubular conduit is greater than a pressure within the subterranean formation.

While the presence of the standing valve many be beneficial to the overall operation of the well, it may make it difficult to position, or at least to economically position, a downhole device within the tubular conduit and/or near a downhole end of the tubular conduit, especially when the tubular conduit extends within a horizontal and/or deviated well. Thus, there exists a need for pump-through standing valves, for wells including the pump-through standing valves, and/or for improved methods of utilizing pump-through standing valves to deploy downhole devices.

SUMMARY OF THE DISCLOSURE

Pump-through standing valves, wells including the pump-through standing valves, and methods of utilizing pump-through standing valves to deploy downhole devices are disclosed herein. The pump-through standing valves include a valve body, a standing valve at least partially formed within the valve body, and a flow-through valve at least partially formed within the valve body. The standing valve includes a standing valve fluid conduit and a standing valve flow control device. The standing valve fluid conduit extends between a wellbore-exposed region of the valve body and a tubular conduit-exposed region of the valve body. The standing valve flow control device is configured to permit a fluid inflow via the standing valve fluid conduit and to resist a fluid outflow via the standing valve fluid conduit. The flow-through valve includes a flow-through valve fluid conduit and a flow-through valve flow control device. The flow-through valve fluid conduit extends between the wellbore-exposed region of the valve body and the tubular conduit-exposed region of the valve body. The flow-through valve flow control device is configured to selectively permit the fluid outflow via the flow-through valve fluid conduit when an outflow pressure differential exceeds a threshold outflow pressure differential. The flow-through valve flow control device further is configured to selectively restrict the fluid outflow when the outflow pressure differential is less than the threshold outflow pressure differential.

The wells include a wellbore, which extends within a subterranean formation, and a wellbore tubular, which extends within the wellbore. The wells also include the pump-through standing valve, and the pump-through standing valve is operatively attached to the wellbore tubular.

The methods include methods of utilizing the pump-through standing valve and/or the well to deploy a downhole device. These methods include positioning a downhole device within an uphole region of a tubular conduit, which is defined by a wellbore tubular that extends within a wellbore that extends within a subterranean formation. The methods also include providing a conveyance fluid to an uphole region of the tubular conduit to pressurize the tubular conduit such that an outflow pressure differential is at least a threshold outflow pressure differential. The methods further include initiating flow of the conveyance fluid from the tubular conduit via a flow-through valve fluid conduit of the pump-through standing valve responsive to the outflow pressure differential exceeding the threshold outflow pressure differential. The methods also include conveying the downhole device within the tubular conduit and in a downhole direction within the conveyance fluid to position the downhole device within a target region of the tubular conduit. The methods then include ceasing the providing the conveyance fluid such that the outflow pressure differential decreases to less than the threshold outflow pressure differential and restricting flow of the conveyance fluid through the flow-through valve fluid conduit responsive to the outflow pressure differential decreasing to less than the threshold outflow pressure differential. The methods further include decreasing an internal pressure within the tubular conduit such that an inflow pressure differential is at least a threshold inflow pressure differential and subsequently receiving a wellbore fluid into the tubular conduit via a standing valve fluid conduit of the pump-through standing valve.

DETAILED DESCRIPTION AND BEST MODE OF THE DISCLOSURE

Figure 1:
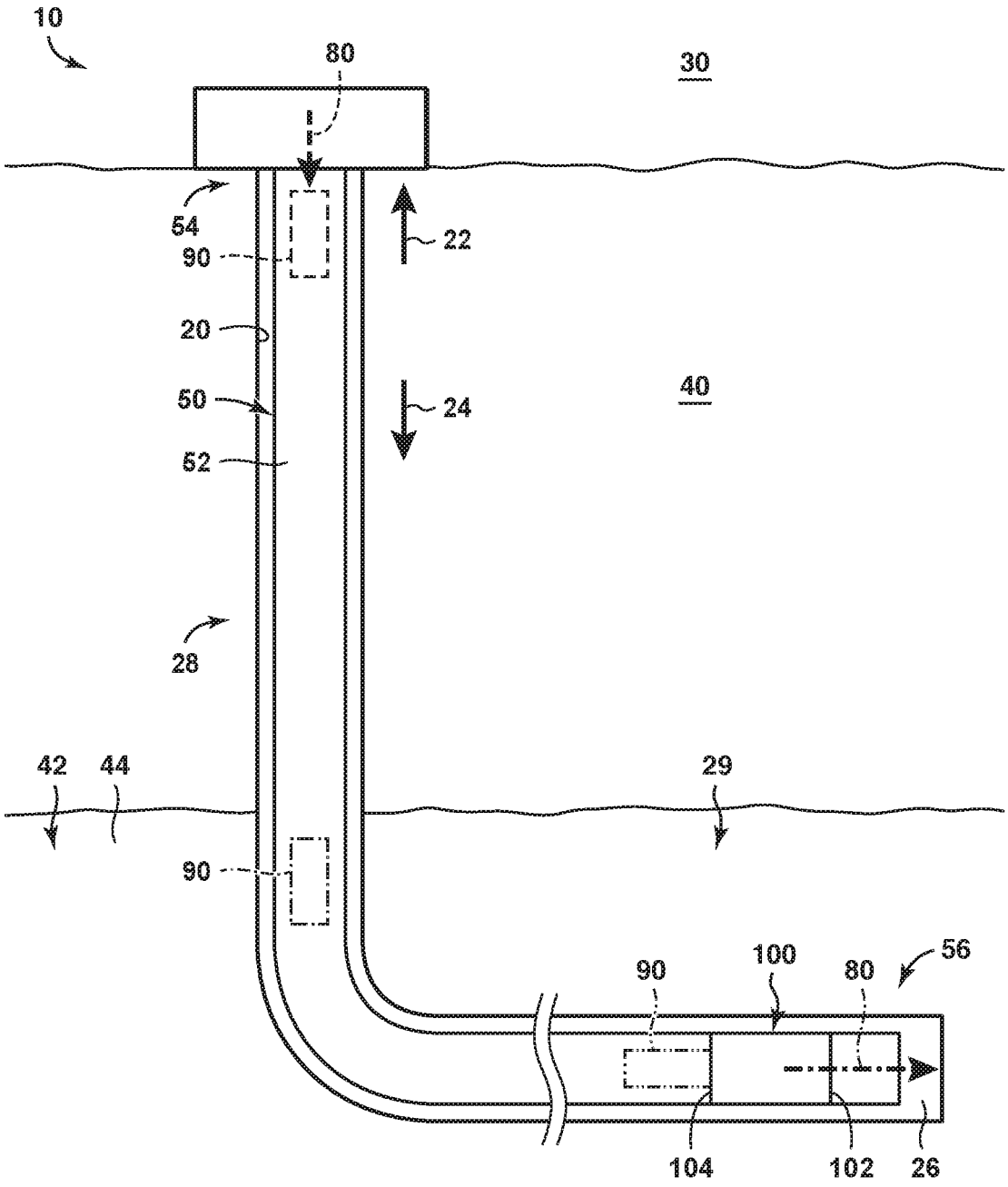
FIG. 1 is a schematic cross-sectional view of a well including a pump-through standing valve, according to the present disclosure.

FIGS. 1-7 provide examples of pump-through standing valves 100, of wells 10 including pump-through standing valves 100, and/or of methods 200 of utilizing a pump-through standing valve to deploy a downhole device, according to the present disclosure. Elements that serve a similar, or at least substantially similar, purpose are labeled with like numbers in each of FIGS. 1-7, and these elements may not be discussed in detail herein with reference to each of FIGS. 1-7. Similarly, not all elements may be labeled in each of FIGS. 1-7, but reference numerals associated therewith may be utilized herein for consistency. Elements, components, and/or features that are discussed herein with reference to one or more of FIGS. 1-7 may be included in and/or utilized with any of FIGS. 1-7 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic cross-sectional view of a well 10 including a pump-through standing valve 100, according to the present disclosure. Well 10 includes a wellbore 20 that extends within a subterranean formation 42. Wellbore 10 also may be referred to herein as extending within a subsurface region 40 that includes subterranean formation 42, as extending between a surface region 30 and subsurface region 40, and/or as extending between the surface region and the subterranean formation. Wellbore 20 may include a vertical, or at least substantially vertical, portion, or region, 28. Additionally or alternatively, wellbore 20 also may include a deviated, a horizontal, or an at least substantially horizontal portion, or region, 29.

Subterranean formation 42 may include a reservoir fluid 44, such as a hydrocarbon fluid, and well 10 may be utilized to facilitate production of the reservoir fluid from the subterranean formation. When the reservoir fluid includes the hydrocarbon fluid, well 10 also may be referred to herein as a hydrocarbon well 10.

Well 10 also includes a wellbore tubular 50, such as a casing string and/or a tubing string, that extends within wellbore 20 and defines a tubular conduit 52. Pump-through standing valve 100 also may be referred to herein as a valve assembly 100, a standing valve assembly 100, and/or a pump-through standing valve assembly 100. Pump-through standing valve 100 is operatively attached to a downhole portion, region, and/or end, 56 of wellbore tubular 50. This operative attachment may be such that a wellbore-exposed region 102 of pump-through standing valve 100 is exposed to, faces toward, and/or is in fluid contact with wellbore 20. In addition, the operative attachment also may be such that a tubular conduit-exposed region 104 of pump-through standing valve 100 is exposed to, faces toward, and/or is in fluid contact with tubular conduit 52. Stated another way, tubular conduit-exposed region 104 may at least partially define tubular conduit 52 and/or wellbore tubular 50 may separate tubular conduit-exposed region 104 from wellbore 20, from subsurface region 40, and/or from subterranean formation 42.

As also illustrated in FIG. 1, a wellbore fluid 26 may extend within wellbore 20 and/or within tubular conduit 52. This wellbore fluid may include, or be, reservoir fluid 44. Additionally or alternatively, this wellbore fluid may include, or be, another fluid that is provided to the wellbore from surface region 30.

As further illustrated in FIG. 1, well 10 and/or wellbore 20 thereof may define an uphole portion, region, and/or end 54, and the uphole portion may be proximate, may be near, and/or may open into surface region 30. Stated another way, uphole portion 54 may be uphole from, or located in an uphole direction 22 from, downhole portion 56. Conversely, downhole portion 56 may be downhole from, or located in a downhole direction 24 from, uphole portion 54.

During operation of wells 10 that include wellbores 20, wellbore tubulars 50, and pump-through standing valves 100, it may be desirable to position a downhole device 90 within tubular conduit 52 and/or within a portion of the tubular conduit that extends within deviated portion 29 of wellbore 20. Examples of downhole device 90 include any suitable pump, well control device, barrier, and/or sensor.

Figure 7:
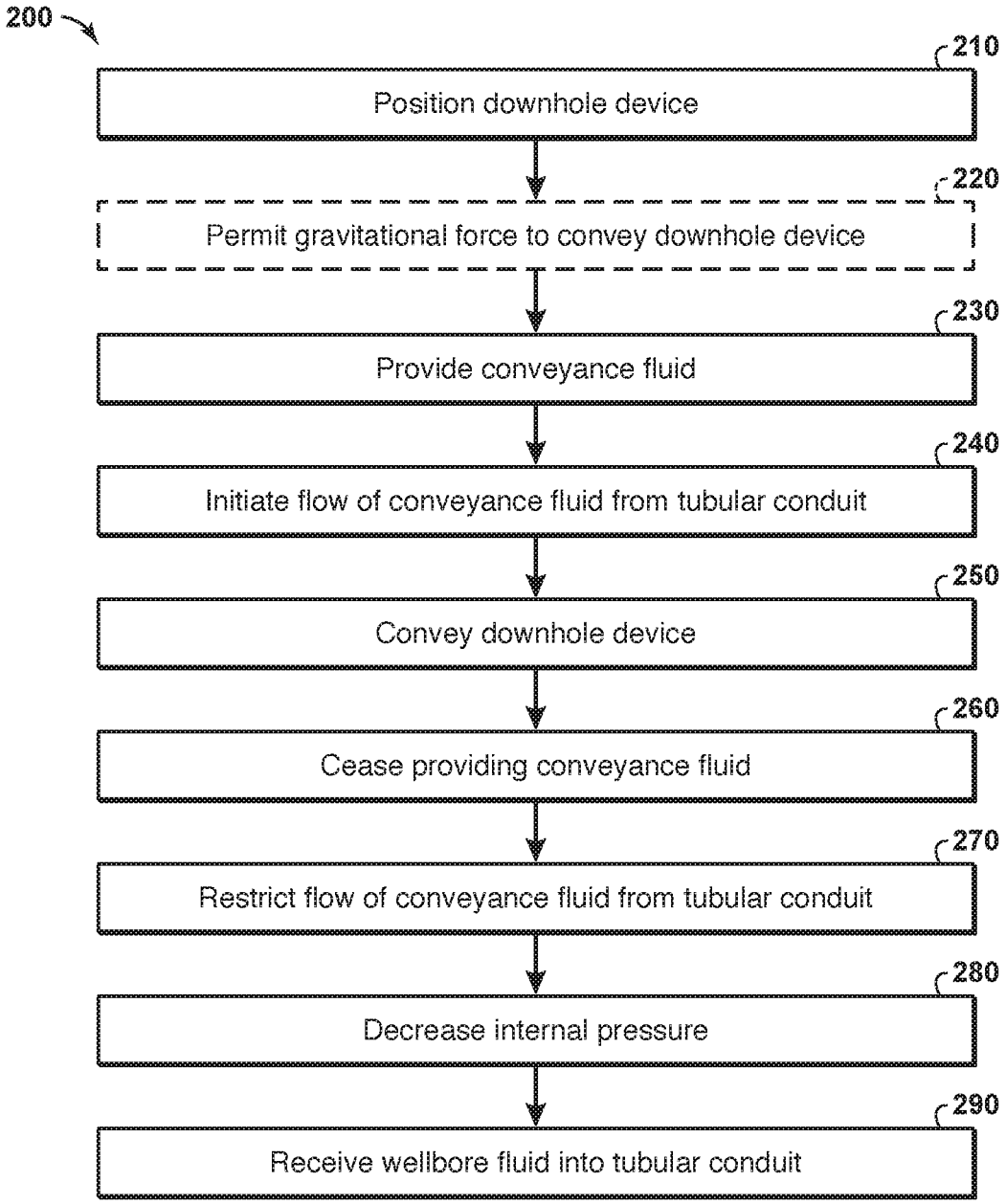
FIG. 7 is a flowchart depicting methods, according to the present disclosure, of utilizing a pump-through standing valve to deploy a downhole device.

Under these conditions, and as discussed in more detail herein with reference to methods 200 of FIG. 7, downhole device 90 may be positioned within uphole region 54 of tubular conduit 52, as illustrated in dashed lines in FIG. 1. A conveyance fluid 80 then may be provided to the tubular conduit to pressurize the tubular conduit and/or to generate an outflow pressure differential across pump-through standing valve 100. The outflow pressure differential is defined when, or such that, an internal pressure exerted on tubular conduit-exposed region 104 exceeds an external pressure exerted on wellbore-exposed region 102.

When the outflow pressure differential is at least, or exceeds, a threshold outflow pressure differential, pump-through standing valve 100 permits a fluid outflow of the conveyance fluid to flow from the tubular conduit and into the subterranean formation, as illustrated in dash-dot lines in FIG. 1. Thus, the pump-through standing valve permits and/or establishes a flow of the conveyance fluid within tubular conduit 52 and in downhole direction 24, and this flow conveys downhole device 90 in downhole direction 24, as illustrated in dash-dot lines in FIG. 1. The threshold outflow pressure differential generally is specified, or selected, to be greater than a hydrostatic pressure experienced, or expected to be experienced, by the pump-through standing valve when the conveyance fluid is not provided to the tubular conduit. As examples, the threshold outflow pressure differential may be at least 105%, at least 110%, at least 120%, at least 130%, at least 140%, at least 150%, or at least 200% of the hydrostatic pressure.

Flow of the conveyance fluid conveys downhole device 90 in downhole direction 24 and may permit the downhole device to be conveyed in vertical portion 28 and/or in deviated portion 29 of wellbore 20. Thus, the downhole device may be conveyed, flowed, and/or positioned within any suitable, or target, portion, or region, of the tubular conduit, as illustrated in dash-dot-dot lines in FIG. 1.

Subsequent to the downhole device being positioned within the target region of the tubular conduit, flow of the conveyance fluid into the wellbore tubular may be ceased, thereby permitting the outflow pressure differential to decrease to less than the threshold outflow pressure differential and causing pump-through standing valve 100 to restrict flow of the conveyance fluid therethrough. The internal pressure then may be decreased such that an inflow pressure differential is at least, or exceeds, a threshold inflow pressure differential. The inflow pressure differential is defined when the external pressure exceeds the internal pressure. When the inflow pressure differential is at least the threshold inflow pressure differential, a fluid inflow of wellbore fluid 26 may flow into tubular conduit 52 from subterranean formation 42 via pump-through standing valve 100, thereby permitting production of the wellbore fluid.

It is within the scope of the present disclosure that pump-through standing valve 100 may be positioned within wellbore 20 and/or operatively attached to wellbore tubular 50 in any suitable manner and/or with any suitable timing. As an example, pump-through standing valve 100 may be operatively attached to wellbore tubular 50 prior to the wellbore tubular being positioned within the subterranean formation. Under these conditions, the pump-through standing valve may function as a pressure relief valve that prevents over-pressurization of the wellbore tubular during pressure testing thereof. As another example, the pump-through standing valve may be flowed into the subterranean formation, via tubular conduit 52, subsequent to the wellbore tubular being positioned within the subterranean formation.

Figure 2:
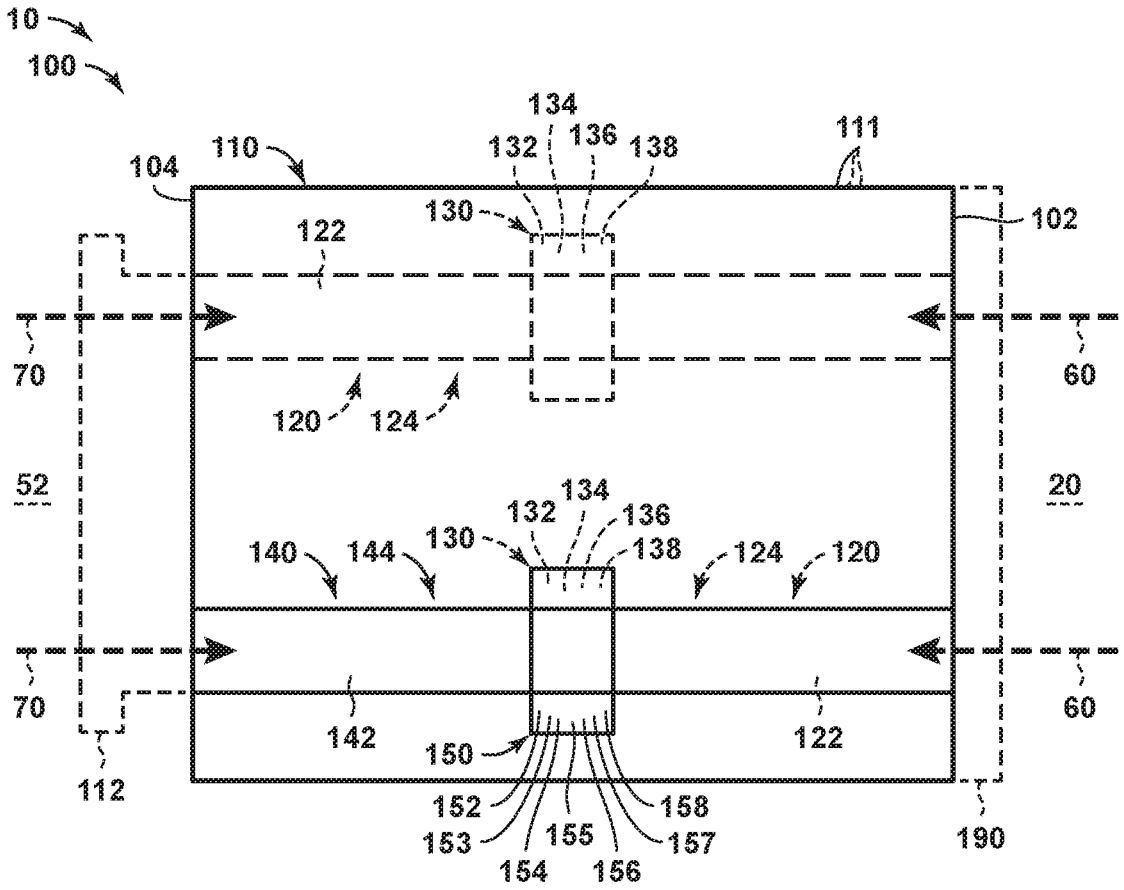
FIG. 2 is a schematic representation of pump-through standing valves according to the present disclosure.

FIG. 2 is a schematic representation of pump-through standing valves 100, according to the present disclosure, while FIGS. 3-6 are less schematic views of a pump-through standing valve 100, according to the present disclosure. FIGS. 2-6 may include and/or be more detailed views of pump-through standing valve 100 of FIG. 1. As such, any of the structures, functions, and/or features discussed herein with reference to pump-through standing valves 100 of FIG. 1 may be included in and/or utilized with pump-through standing valves 100 of FIGS. 2-6 without departing from the scope of the present disclosure. Similarly, any pump-through standing valve 100 of any of FIGS. 2-6 may be included in and/or utilized with wells 10 of FIG. 1 without departing from the scope of the present disclosure.

Pump-through standing valves 100 include a valve body 110 including a wellbore-exposed region 102 and a tubular conduit-exposed region 104, which are discussed in more detail herein with reference to FIG. 1. Pump-through standing valves 100 also include a standing valve 120, which is at least partially formed within the valve body, and a flow-through valve 140, which also is at least partially formed within the valve body. Pump-through standing valve 100 additionally or alternatively may be referred to herein as including a plurality of valve members 111, with these valve members 111 defining valve body 110, standing valve 120, and/or flow-through valve 140.

As also discussed herein with reference to FIG. 1 and illustrated in FIG. 2, standing valve 120 is configured to permit a fluid inflow 60, from subterranean formation 20 and into tubular conduit 52, when the inflow pressure differential is at least the threshold inflow pressure. In addition, standing valve 120 also is configured to resist a fluid outflow 70 from the tubular conduit and into the subterranean formation. In contrast, flow-through valve 140 is configured to permit fluid outflow 70 when an outflow pressure differential is at least the threshold outflow pressure differential and to restrict the fluid outflow when the outflow pressure differential is less than the threshold outflow pressure differential.

Standing valve 120 may include, or be, any suitable structure that may selectively permit the fluid inflow and also resist the fluid outflow, at least when the outflow pressure differential is less than the threshold outflow pressure differential. As an example, standing valve 120 may include, or be, a check valve 124, which also may be referred to herein as a standing check valve 124.

Standing valve 120 includes a standing valve fluid conduit 122, which extends between wellbore-exposed region 102 and tubular conduit-exposed region 104 of valve body 110. Standing valve 120 also includes a standing valve flow control device 130. Standing valve flow control device 130 is configured to permit the fluid inflow via standing valve fluid conduit 122 and also to resist the fluid outflow via the standing valve fluid conduit. Examples of the standing valve flow control device include a ball 134 and seat 136 and/or a flapper 138.

As another example, and as illustrated in FIG. 2, standing valve 120 may include a standing valve biasing mechanism 132. Standing valve biasing mechanism 132, when present, may be configured to bias standing valve 120 to a standing valve closed position. In addition, the standing valve biasing mechanism also may be configured to permit standing valve 120 to transition to a standing valve open position when the inflow pressure differential is at least the threshold inflow pressure differential. When in the standing valve closed position, the standing valve flow control device restricts fluid flow through the standing valve fluid conduit. When in the standing valve open position, standing valve 120 permits the fluid inflow.

Standing valve biasing mechanism 132 may have any suitable structure and/or structures. As examples, the standing valve biasing mechanism may include one or more of a spring, a resilient material, a gravitational force, and/or an elastomeric material.

The threshold inflow pressure differential may have any suitable value. As examples, a magnitude of the threshold inflow pressure differential may be at most 25%, at most 10%, at most 5%, at most 1%, or at most 0.1% of the threshold outflow pressure differential, or of a magnitude of the threshold outflow pressure differential. As additional examples, the threshold inflow pressure differential may be at most 100 kilopascals (kPa), at most 50 kPa, at most 25 kPa, at most 10 kPa, or at most 1 kPa.

Flow-through valve 140 may include, or be, any suitable structure that may selectively permit the fluid outflow when the outflow pressure differential exceeds the threshold outflow pressure differential and that also may selectively restrict the fluid outflow when the outflow pressure differential is less than the threshold outflow pressure differential. As an example, flow-through valve 140 may include, or be, a check valve 144, or a flow-through check valve 144.

Flow-through valve 140 includes a flow-through valve fluid conduit 142, which extends between wellbore-exposed region 102 and tubular conduit-exposed region 104. Flow-through valve 140 also includes a flow-through valve flow control device 150. Flow-through valve flow control device 150 is configured to selectively permit the fluid outflow via the flow-through valve fluid conduit when the outflow pressure differential is at least the threshold outflow pressure differential. In addition, the flow-through valve flow control device also is configured to selectively restrict the fluid outflow via the flow-through valve fluid conduit when the outflow pressure differential is less than the threshold outflow pressure differential.

The threshold outflow pressure differential may have and/or define any suitable value, or magnitude. As examples, the threshold outflow pressure differential may be at least 0.5 megapascals (MPa), at least 1 MPa, at least 10 MPa, at least 20 MPa, or at least 100 MPa. As additional examples, the threshold outflow pressure differential may be at most 70 MPa, at most 60 MPa, at most 50 MPa, at most 40 MPa, or at most 30 MPa.

It is within the scope of the present disclosure that standing valve fluid conduit 122 may be at least partially, or even completely, separate, distinct, and/or spaced-apart from flow-through valve fluid conduit 142. Additionally or alternatively, it is also within the scope of the present disclosure that standing valve fluid conduit 122 may be at least partially, or even completely, coextensive with flow-through valve fluid conduit 142 and/or that the standing valve fluid conduit and the flow-through valve fluid conduit may be the same fluid conduit. Similarly, standing valve flow control device 130 may be at least partially, or even completely, distinct from the flow-through valve flow control device and/or may include, or be, the flow-through valve flow control device.

When the flow-through valve fluid conduit is at least partially distinct from the standing valve fluid conduit, each fluid conduit may be sized for a desired fluid flow rate therethrough. As an example, the fluid conduits may be sized such that the fluid inflow, via the standing valve fluid conduit, is greater than the fluid outflow, via the flow-through valve fluid conduit. With this in mind, a ratio of an average, or minimum, transverse cross-sectional area of the standing valve fluid conduit to an average, or minimum, transverse cross-sectional area of the flow-through valve fluid conduit may be at least 1, at least 2.5, at least 5, at least 10, or at least 20.

Flow-through valve flow control device 150 may include any suitable structure and/or structures. As an example, the flow-through valve flow control device may include a flow-through valve biasing mechanism 152 configured to resist the fluid outflow until the outflow pressure differential is at least the threshold outflow pressure differential. The flow-through valve flow control device also may be configured to resist the fluid inflow via the flow-through valve fluid conduit; however, this is not required of all embodiments, including those embodiments in which the flow-through valve fluid conduit includes, or is, the standing valve fluid conduit. Examples of the flow-through valve flow control device may include one or more of a bellows 153, a diaphragm 154, a bearing 155, a ball 156, a seat 157, and/or a flapper 158.

Flow-through valve 140 may have and/or define a flow-through valve open state, or an open state, in which the flow-through valve permits the fluid outflow, and a flow-through valve closed state, or a closed state, in which the flow-through valve resists the fluid outflow. In addition, the flow-through valve may be configured to transition, or to selectively transition, between the flow-through valve open state and the flow-through valve closed state based upon, based solely upon, and/or based entirely upon the outflow pressure differential. Stated another way, the flow-through valve flow control device may be pressure-actuated. Stated yet another way, the flow-through valve flow control device may not be electrically actuated. Stated another way, the flow-through valve may be free of an electronic controller and/or may not be electrically controlled.

As illustrated in dashed lines in FIG. 2, pump-through standing valve 100 also may include an inlet screen 190. Inlet screen 190, when present, may be adapted, configured, designed, and/or constructed to restrict a flow of a particulate material into standing valve fluid conduit 122 from wellbore-exposed region 102 of valve body 110.

As also illustrated in dashed lines in FIG. 2, valve body 110 may include a fish-neck 112, which also may be referred to herein as a retrieval neck 112, as a retrieval fixture 112, and/or as a connection point 112. Fish-neck 112, when present, may be configured to permit and/or facilitate retrieval of pump-through standing valve 100 from tubular conduit 52 while the wellbore tubular is positioned within the wellbore.

It is within the scope of the present disclosure that pump-through standing valve 100, including valve body 110, standing valve 120, flow-through valve 140, and/or any suitable valve member 111 thereof, may be formed and/or defined from any suitable material and/or materials. Examples of such materials include one or more of a metallic material, an elastomeric material, a resilient material, and/or a polymeric material.

Figure 3:
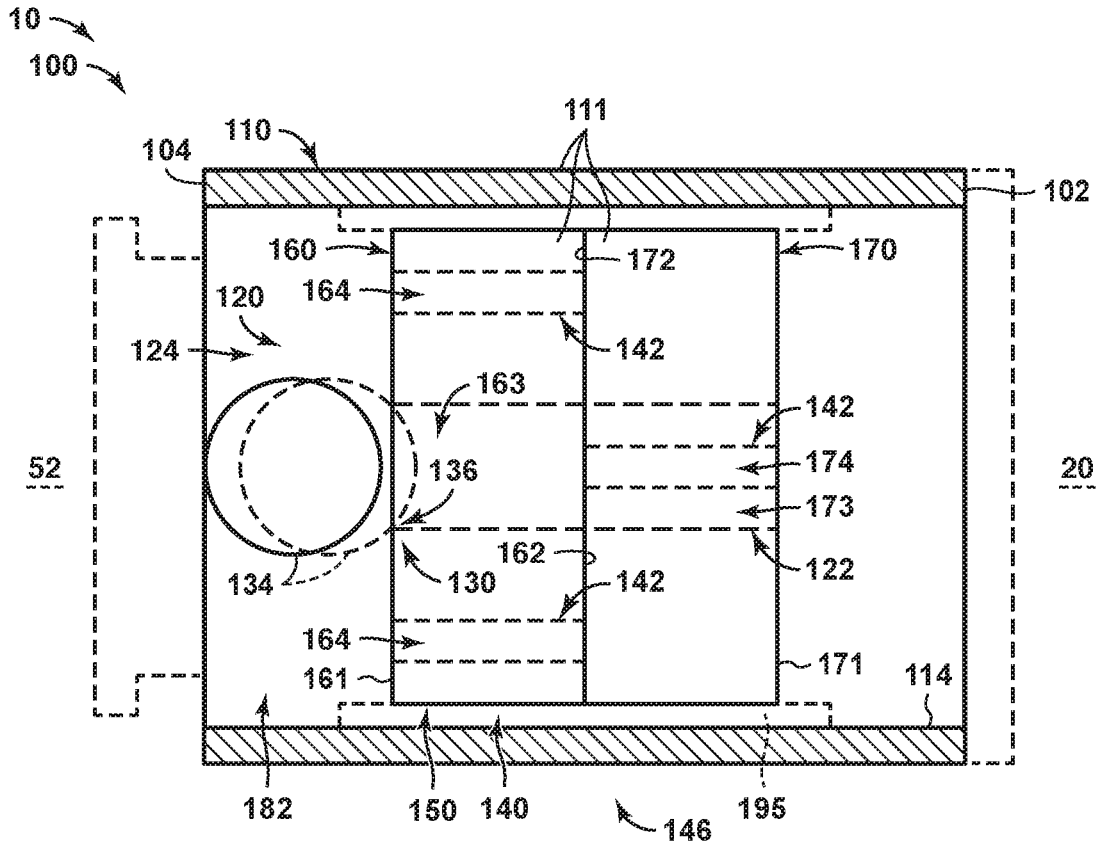
FIG. 3 is a less schematic cross-sectional view of a pump-through standing valve, according to the present disclosure, illustrating a flow-through valve thereof in a closed state.
Figure 4:
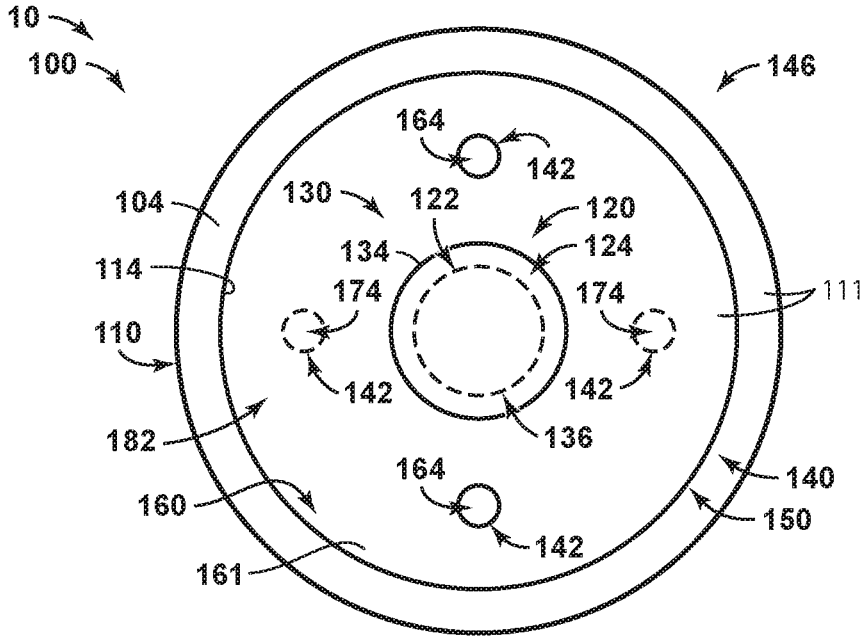
FIG. 4 is a top view of the pump-through standing valve of FIG. 3.
Figure 5:
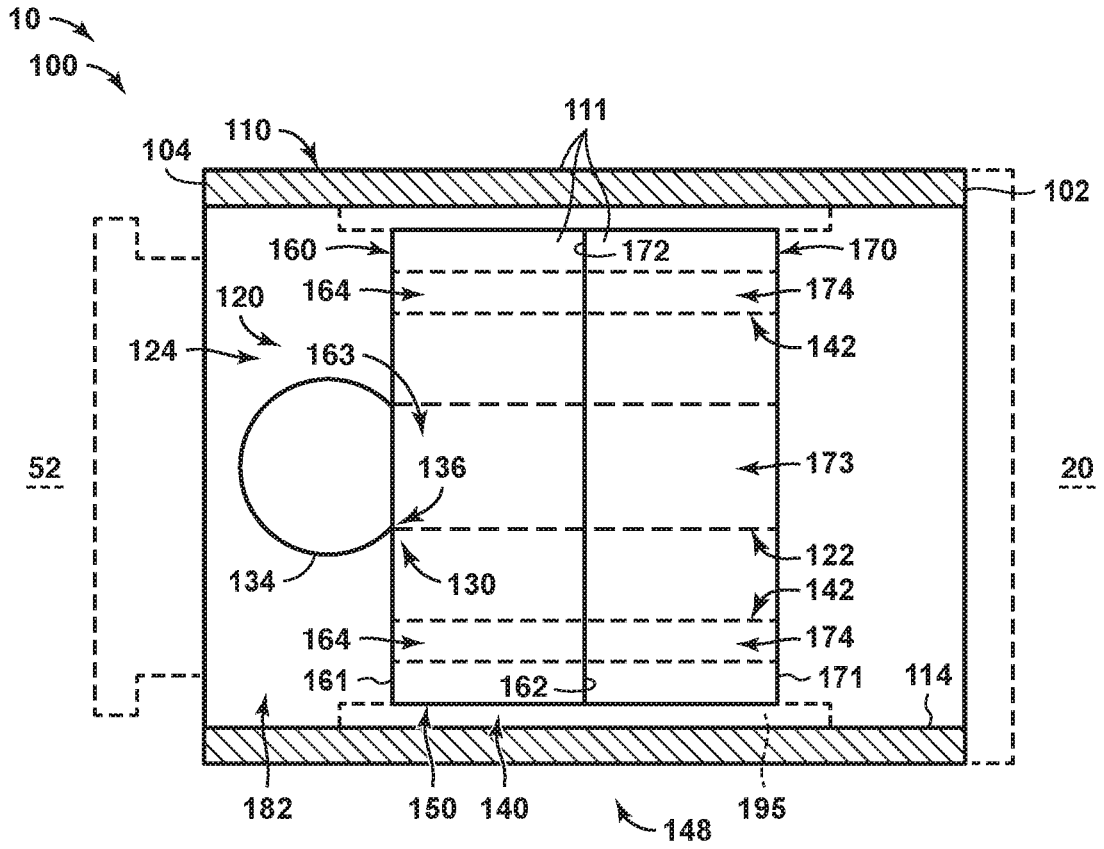
FIG. 5 is a cross-sectional view of the pump-through standing valve of FIGS. 3-4 illustrating the flow-through valve in an open state.
Figure 6:
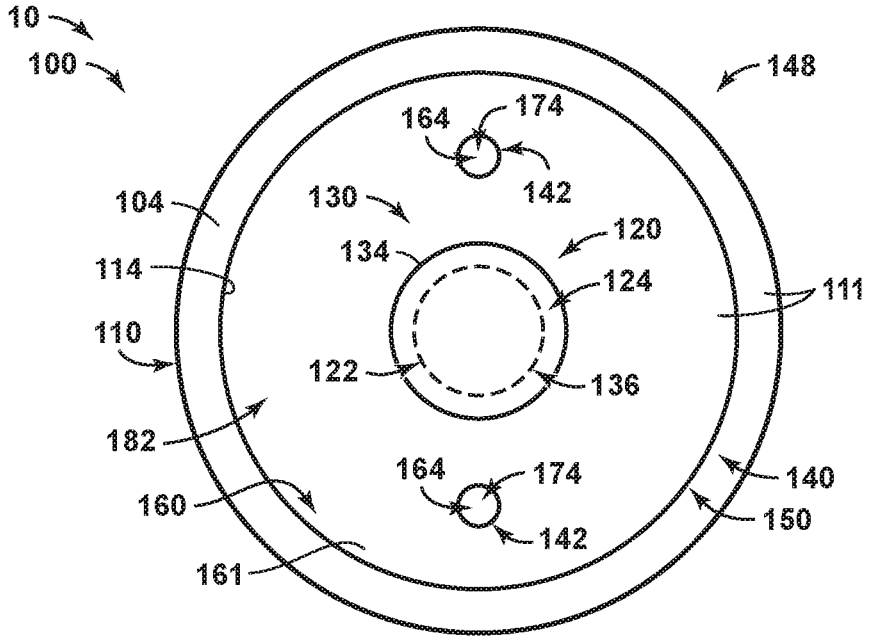
FIG. 6 is a top view of the pump-through standing valve of FIG. 5.

FIGS. 3-6 provide more detailed illustrations of an example of a pump-through standing valve 100 according to the present disclosure. More specifically, FIG. 3 is a cross-sectional view of pump-through standing valve 100 illustrating flow-through valve 140 thereof in a closed state 146, and FIG. 4 is a top view of the pump-through standing valve of FIG. 3. In addition, FIG. 5 is a cross-sectional view of pump-through standing valve 100 of FIGS. 3-4 illustrating flow-through valve 140 in an open state 148, and FIG. 6 is a top view of the pump-through standing valve of FIG. 5.

FIGS. 3-6 may include and/or be more detailed and/or less schematic views of pump-through standing valve 100 of FIG. 2. As such, any of the structures, functions, and/or features discussed herein with reference to FIG. 2 may be included in and/or utilized with pump-through standing valves 100 of FIGS. 3-6 without departing from the scope of the present disclosure. Similarly, any of the structures, functions, and/or features discussed herein with reference to pump-through standing valves 100 any of FIGS. 3-6 may be included in and/or utilized with pump-through standing valves 100 of FIG. 2 without departing from the scope of the present disclosure.

In the example of FIGS. 3-6, valve body 110 of pump-through standing valve 100 defines a body opening 114, which extends between wellbore-exposed region 102 and tubular conduit-exposed region 104. Pump-through standing valve 100 of FIGS. 3-6 also includes a ball, or sealing ball, 134 and a sealing ball retention region 182 that is configured to retain the sealing ball. Pump-through standing valve 100 further includes a conduit-exposed valve plate 160 and a wellbore-exposed valve plate 170.

Conduit-exposed valve plate 160 extends across a first transverse cross-section of body opening 114 and defines a first conduit-exposed plate side 161 and an opposed second conduit-exposed plate side 162. Conduit-exposed valve plate 160 is exposed to fluid conduit 52 in that the conduit-exposed valve plate includes a region, or face, (i.e., first conduit-exposed plate side 161) that faces toward, is in fluid contact with, and/or at least partially defines tubular conduit 52 when pump-through standing valve 100 is operatively attached to the tubular conduit, as illustrated in FIG. 1.

Returning to FIGS. 3-6, Conduit-exposed valve plate 160 also defines a first conduit-exposed plate aperture 163 and at least one second conduit-exposed plate aperture 164. First conduit-exposed plate aperture 163 is defined within a central region of the conduit-exposed valve plate and extends between the first conduit-exposed plate side and the second conduit-exposed plate side. Second conduit-exposed plate aperture 164 is defined within a peripheral region of the conduit-exposed valve plate and also extends between the first conduit-exposed plate side and the second conduit-exposed plate side.

Conduit-exposed valve plate 160 further defines a seat, or a ball seat, 136. Ball seat 136 defines at least a portion, such as an entrance, of first conduit-exposed plate aperture 163 and is defined on first conduit-exposed plate side 161. In addition, ball seat 136 is shaped to form a fluid seal with sealing ball 134 and defines at least a portion of sealing ball retention region 182.

Wellbore-exposed valve plate 170 extends across a second transverse cross-section of body opening 114 and defines a first wellbore-exposed plate side 171 and an opposed second wellbore-exposed plate side 172. Wellbore-exposed valve plate 170 is exposed to wellbore 20 in that the wellbore-exposed valve plate includes a region, or face, (i.e., first wellbore-exposed plate side 171) that faces toward and/or is in fluid contact with wellbore 20 when pump-through standing valve 100 is positioned within subterranean formation 42 (illustrated in FIG. 1).

Wellbore-exposed valve plate 170 also defines a first wellbore-exposed plate aperture 173 and at least one second wellbore-exposed plate aperture 174. First wellbore-exposed plate aperture 173 is defined within a central region of the wellbore-exposed valve plate and extends between the first wellbore-exposed plate side and the second wellbore-exposed plate side. Second wellbore-exposed plate aperture is defined within a peripheral region of the wellbore-exposed valve plate and also extends between the first wellbore-exposed plate side and the second wellbore-exposed plate side. In addition, second wellbore-exposed plate side 172 faces toward, contacts, and/or mechanically contacts second conduit-exposed plate side 162.

As illustrated in FIGS. 3-6, and regardless of whether flow-through valve 140 is in closed state 146 of FIGS. 3-4 or open state 148 of FIGS. 5-6, first conduit-exposed plate aperture 163 and first wellbore-exposed plate aperture 173 are aligned with one another to define standing valve fluid conduit 122. In addition, and as illustrated in FIG. 3, sealing ball 134 is free to move, within sealing ball retention region 182, between at least a sealed configuration, as illustrated in dashed lines, and an unsealed configuration, as illustrated in solid lines. When in the sealed configuration, the sealing ball forms the fluid seal with ball seat 136 and resists the fluid outflow from tubular conduit 52 into subterranean formation 20. Conversely, when in the unsealed configuration, sealing ball 134 does not form the fluid seal with the ball seat and/or permits fluid flow between the tubular conduit and the subterranean formation. A fluid inflow from subterranean formation 20 and into tubular conduit 52, via standing valve fluid conduit 122, tends to urge sealing ball 134 toward the unsealed configuration, while a fluid outflow from the tubular conduit into the subterranean formation tends to urge the sealing ball toward the sealed configuration. Thus, sealing ball 134 and ball seat 136 may be referred to herein as together defining standing valve flow control device 130.

Second conduit-exposed plate aperture 164 and second wellbore-exposed plate aperture 174 together define flow-through valve fluid conduit 142 of flow-through valve 140. In addition, conduit-exposed valve plate 160 and wellbore-exposed valve plate 170 are configured for rotation relative to one another and/or to rotate within body opening 114 such that the conduit-exposed valve plate and the wellbore-exposed valve plate together define flow-through valve flow control device 150.

This rotation may include rotation to closed state 146, which is illustrated in FIGS. 3-4. When in the closed state, second conduit-exposed plate aperture 164 and second wellbore-exposed plate aperture 174 are misaligned with one another such that fluid flow, or the fluid outflow, through the flow-through valve fluid conduit is restricted.

This rotation also may include rotation to open state 148, which is illustrated in FIGS. 5-6. When in the open state, second conduit-exposed plate aperture 164 and second wellbore-exposed plate aperture 174 are aligned with one another such that fluid flow, or the fluid outflow, through the flow-through valve fluid conduit is permitted. Rotation of the conduit-exposed valve plate and the wellbore-exposed valve plate, relative to one another, may be controlled and/or regulated by a rotation-regulating structure 195.

As an example, and when the inflow pressure differential is at least a threshold inflow pressure differential sufficient to unseat sealing ball 134 from ball seat 136, sealing ball 134 may move to the configuration that is illustrated in solid lines in FIG. 3, thereby permitting the fluid inflow from subterranean formation 20 and/or into tubular conduit 52. When the inflow pressure differential is at least the threshold inflow pressure differential, the outflow pressure differential is negative and/or is less than the threshold outflow pressure differential. As such, conduit-exposed valve plate 160 and wellbore-exposed valve plate 170 are rotated relative to one another such that second conduit-exposed plate aperture 164 and second wellbore-exposed plate aperture 174 are misaligned, or such that flow-through valve 140 is in closed state 146. Thus, fluid flow through flow-through valve fluid conduit 142 is restricted, occluded, resisted, and/or blocked.

In contrast, when the outflow pressure differential is at least the threshold outflow pressure differential, the outflow pressure differential urges sealing ball 134 into sealing contact with ball seat 136, thereby resisting fluid outflow via standing valve fluid conduit 122. This is illustrated in FIG. 5. However, and as illustrated in FIGS. 5-6, when the outflow pressure differential exceeds the threshold outflow pressure differential, conduit-exposed valve plate 160 and wellbore-exposed valve plate 170 rotate, relative to one another, to open state 148 and/or such that second conduit-exposed plate aperture 164 is aligned with second wellbore-exposed plate aperture 174. As such, fluid outflow through flow-through valve fluid conduit 142 is permitted. When the outflow pressure differential decreases to less than the threshold outflow pressure differential, conduit-exposed valve plate 160 and wellbore-exposed valve plate 170 return to closed state 146, as illustrated in FIGS. 3-4.

FIG. 7 is a flowchart depicting methods 200, according to the present disclosure, of utilizing a pump-through standing valve to deploy a downhole device within a tubular conduit of a wellbore tubular. The wellbore tubular extends within a wellbore that extends within a subterranean formation, and a pump-through standing valve assembly, such as pump-through standing valve 100 of FIGS. 1-6, is operatively attached to a downhole portion of the wellbore tubular.

Methods 200 include positioning the downhole device at 210 and may include permitting a gravitational force to convey the downhole device at 220. Methods 200 further include providing a conveyance fluid to a tubular conduit at 230, initiating flow of the conveyance fluid from the tubular conduit at 240, and conveying the downhole device at 250. Methods 200 also include ceasing the providing the conveyance fluid at 260, restricting flow of the conveyance fluid from the tubular conduit at 270, decreasing an internal pressure within the tubular conduit at 280, and receiving a wellbore fluid into the tubular conduit at 290.

Positioning the downhole device at 210 may include positioning the downhole device within an uphole region, or portion, of the tubular conduit, such as uphole portion 54 of FIG. 1. The downhole device may include any suitable downhole device, examples of which are discussed herein with reference to downhole device 90 of FIG. 1. One specific example of the downhole device is a pump.

Permitting the gravitational force to convey the downhole device at 220 may include permitting any suitable gravitational force, which acts on the downhole device, to provide a motive force for conveyance of, or to accelerate, the downhole device in the downhole direction within the tubular conduit. The permitting at 220 may include waiting at least a threshold permitting time and/or waiting until the downhole device has been conveyed, via the gravitational force, at least a threshold fraction of a length of a vertical, or at least substantially vertical, portion of the tubular conduit. Examples of the threshold fraction of the length of the vertical portion of the tubular conduit include at least 50%, at least 60%, at least 70%, at least 80%, at least 90%, at least 95%, at least 99%, or at least substantially 100% of the length of the vertical portion of the tubular conduit. The permitting at 220 may be performed subsequent to the positioning at 210, prior to the providing at 230, and/or prior to the initiating at 240.

Providing the conveyance fluid to the tubular conduit at 230 may include providing the conveyance fluid to the uphole region of the tubular conduit and/or providing the conveyance fluid from a surface region. The providing at 230 also may include providing to pressurize the tubular conduit and/or providing to establish an outflow pressure differential within the tubular conduit. As discussed herein, the outflow pressure differential may be defined when an internal pressure exerted on a tubular conduit-exposed region of the pump-through standing valve exceeds an external pressure exerted on a wellbore-exposed region of the pump-through standing valve, and the providing at 230 may include providing such that the outflow pressure differential exceeds a threshold outflow pressure differential. Stated another way, the outflow pressure differential may be a pressure differential in which a pressure within the tubular conduit exceeds a pressure external to the tubular conduit and/or a pressure differential that provides a motive force for flow of the conveyance fluid out of the tubular conduit and/or into the subterranean formation. Examples of the threshold outflow pressure differential are disclosed herein.

Initiating flow of the conveyance fluid from the tubular conduit at 240 may include initiating the flow of the conveyance fluid from the tubular conduit via a flow-through valve fluid conduit of the pump-through standing valve. Examples of the flow-through valve fluid conduit are discussed herein with reference to flow-through valve fluid conduit 142 of FIGS. 2-6. The flow-through valve fluid conduit may form a portion of a flow-through valve of the pump-through standing valve, examples of which are discussed herein with reference to flow-through valve 140 of FIGS. 2-6.

The initiating at 240 may be responsive to the outflow pressure differential exceeding the threshold outflow pressure differential. Stated another way, and as discussed herein, the flow-through valve may transition from a closed state, such as closed state 146 of FIGS. 3-4, to an open state, such as open state 148 of FIGS. 5-6. This transition may be responsive to the outflow pressure differential exceeding the threshold outflow pressure differential, and the initiating at 240 may include transitioning the flow-through valve from the closed state to the open state.

Conveying the downhole device at 250 may include conveying the downhole device within the tubular conduit and/or in a downhole direction. This may include conveying, or flowing, the downhole device with and/or within the conveyance fluid, such as within a flow of the conveyance fluid that flows from the uphole portion of the tubular conduit and to, or through, the pump-through standing valve. The conveying at 250 further may include conveying to position the downhole device within a target, desired, or specified region of the tubular conduit and may be responsive to the initiating at 240.

As discussed in more detail herein, the well may include a deviated portion, such as deviated portion 29 of FIG. 1. Under these conditions, the conveying at 250 may include conveying the downhole device through and/or within the deviated portion.

Ceasing the providing the conveyance fluid at 260 may include ceasing, or stopping, flow of the conveyance fluid into the tubular conduit and/or into the uphole portion of the tubular conduit. The ceasing at 260 may be subsequent, or responsive, to the downhole device being positioned within, or reaching, the target region of the tubular conduit.

Additionally or alternatively, the ceasing at 260 may include ceasing such that the outflow pressure differential decreases to less than the threshold outflow pressure differential. Stated another way, the providing at 230 may include continuously, or at least substantially continuously, providing the conveyance fluid to the tubular conduit and/or providing to maintain the outflow pressure differential at, or above, the threshold outflow pressure differential, at least during the initiating at 240 and the conveying at 250. However, and subsequent to the ceasing at 260, the outflow pressure differential may no longer be maintained above the threshold outflow pressure differential.

Restricting flow of the conveyance fluid from the tubular conduit at 270 may include restricting flow of the conveyance fluid through the flow-through valve fluid conduit. This may include transitioning the flow-through valve from the open state to the closed state and may be responsive to the outflow pressure differential decreasing to less than the threshold outflow pressure differential.

Decreasing the internal pressure within the tubular conduit at 280 may include decreasing such that an inflow pressure differential is at least a threshold inflow pressure differential. The inflow pressure differential may be a pressure differential in which the external pressure exerted on the wellbore-exposed region of the pump-through standing valve exceeds the internal pressure exerted on the tubular conduit-exposed region of the pump-through standing valve. Stated another way, the inflow pressure differential may be a pressure differential that provides a motive force for flow of a wellbore fluid into the tubular conduit from the subterranean formation. Stated yet another way, the inflow pressure differential may be opposed to, have an opposite sign from, and/or have an opposite polarity from the outflow pressure differential.

When the downhole device includes the pump, the decreasing at 280 may include decreasing with, via, and/or utilizing the pump, such as by pumping the wellbore fluid to the surface region with the pump. The decreasing at 280 may be performed subsequent to the positioning at 210, subsequent to the permitting at 220, subsequent to the providing at 230, subsequent to the initiating at 240, subsequent to the conveying at 250, subsequent to the ceasing at 260, and/or subsequent to the restricting at 270.

Receiving the wellbore fluid into the tubular conduit at 290 may include receiving the wellbore fluid, which may include a reservoir fluid, from the subterranean formation via a standing valve fluid conduit of the pump-through standing valve. An example of the standing valve fluid conduit includes standing valve fluid conduit 122 that forms a portion of standing valve 120 of FIGS. 2-6.

The receiving at 290 may be subsequent, or responsive, to the decreasing at 280. In addition, and as discussed herein with reference to FIGS. 1-6, methods 200 further may include resisting flow of the conveyance fluid from the tubular conduit and into the subterranean formation, via the pump-through valve fluid conduit, at least during the providing at 230, during the initiating at 240, and during the conveying at 250.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The pump-through standing valves, wells, and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A pump-through standing valve configured to be operatively attached to a wellbore tubular, which defines a tubular conduit and extends within a wellbore that extends within a subterranean formation, the pump-through standing valve comprising:

a single valve body including a wellbore-exposed region and a tubular conduit-exposed region, wherein the valve body is configured to interface with a single fluid passage at each of the wellbore-exposed region and the tubular conduit-exposed region;

a standing valve at least partially formed within the valve body, the standing valve comprising:

(i) a standing valve fluid conduit extending longitudinally through the valve body along a central axis and between the wellbore-exposed region of the valve body and the tubular conduit-exposed region of the valve body; and (ii) a standing valve flow control device configured move axially along the valve body to permit a fluid inflow, via the standing valve fluid conduit, from the wellbore into the tubular conduit and also to resist a fluid outflow, via the standing valve fluid conduit, from the tubular conduit into the subterranean formation; and a flow-through valve at least partially formed within the valve body, the flow-through valve comprising:

(i) a flow-through valve fluid conduit fluidly extending between the wellbore-exposed region of the valve body and the tubular conduit-exposed region of the valve body; and (ii) a flow-through valve flow control device configured to rotate about the central axis with respect to a portion of the valve body to selectively permit the fluid outflow from the tubular conduit exposed region to the wellbore exposed region via the flow-through valve fluid conduit when an outflow pressure differential across the flow-through valve flow control device is at least a threshold outflow pressure differential, wherein the outflow pressure differential is a pressure differential in which a pressure exerted on the tubular conduit-exposed region of the valve body exceeds a pressure exerted on the wellbore-exposed region of the valve body, wherein the flow-through valve flow control device is configured to rotate about the central axis with respect to the portion of the valve body to selectively restrict the fluid outflow to the wellbore-exposed region when the outflow pressure differential is less than the threshold outflow pressure differential, and wherein the pump-through standing valve is configured to provide fluid flow in a single direction between the wellbore-exposed region and the tubular conduit-exposed region through one of the flow-through valve and the standing valve based on the pressure differential between the wellbore-exposed region and the tubular conduit-exposed region.

2. The pump-through standing valve of claim 1, wherein the standing valve includes a standing valve biasing mechanism configured to bias the standing valve to a standing valve closed position and to permit the standing valve to transition to a standing valve open position when an inflow pressure differential is at least a threshold inflow pressure differential, wherein, when in the standing valve closed position, the standing valve flow control device restricts fluid flow through the standing valve fluid conduit, wherein, when in the standing valve open position, the standing valve permits the fluid inflow, and further wherein the inflow pressure differential is a pressure differential in which the pressure exerted on the wellbore-exposed region of the valve body exceeds the pressure exerted on the tubular conduit-exposed region of the valve body.

3. The pump-through standing valve of claim 2, wherein the standing valve biasing mechanism includes at least one of:

(i) a spring;

(ii) a resilient material;

(iii) a gravitational force; and (iv) an elastomeric material.

4. The pump-through standing valve of claim 1, wherein the standing valve flow control device includes at least one of:

(i) a ball and seat; and (ii) a flapper.

5. The pump-through standing valve of claim 1, wherein the threshold outflow pressure differential is at least 0.5 megapascals (MPa) and at most 70 megapascals (MPa).

6. The pump-through standing valve of claim 1, wherein the standing valve fluid conduit includes at least one of:

(i) is distinct from the flow-through valve fluid conduit;

(ii) is at least partially coextensive with the flow-through valve fluid conduit; and (iii) is the flow-through valve fluid conduit.

7. The pump-through standing valve of claim 1, wherein the standing valve flow control device includes at least one of:

(i) is distinct from the flow-through valve flow control device; and (ii) includes the flow-through valve flow control device.

8. The pump-through standing valve of claim 1, wherein a ratio of an average transverse cross-sectional area of the standing valve fluid conduit to an average transverse cross-sectional area of the flow-through valve fluid conduit is at least 1.

9. The pump-through standing valve of claim 1, wherein the flow-through valve flow control device includes a flow-through valve biasing mechanism configured to resist the fluid outflow until the outflow pressure differential is at least the threshold outflow pressure differential.

10. The pump-through standing valve of claim 1, wherein the flow-through valve flow control device includes at least one of:

(i) a bellows;

(ii) a diaphragm;

(iii) a bearing;

(iv) a ball;

(v) a seat;

(vi) a flapper (vii) a rotating plate with an aperture (viii) a rotating disc with an aperture (ix) a sliding sleeve (x) a choke bean, and (xi) a biasing device.

11. The pump-through standing valve of claim 1, wherein the flow-through valve flow control device is pressure-actuated.

12. The pump-through standing valve of claim 1, wherein the flow-through valve defines a flow-through valve open state, in which the flow-through valve permits the fluid outflow, and a flow-through valve closed state, in which the flow-through valve restricts the fluid outflow.

13. The pump-through standing valve of claim 12, wherein the flow-through valve is configured to selectively transition between the flow-through valve open state and the flow-through valve closed state based solely on the outflow pressure differential.

14. The pump-through standing valve of claim 12, wherein the flow-through valve is biased to the flow-through valve closed state.

15. The pump-through standing valve of claim 1, wherein the flow-through valve flow control device further is configured to resist the fluid inflow via the flow-through valve fluid conduit.

16. A well, comprising:

a wellbore extending within a subterranean formation;

a wellbore tubular defining a tubular conduit and extending within the wellbore; and the pump-through standing valve of claim 1, wherein the pump-through standing valve is operatively attached to a downhole portion of the wellbore tubular such that the wellbore-exposed region is exposed to the wellbore and also such that the tubular conduit-exposed region is exposed to the tubular conduit.

17. The well of claim 16, wherein the threshold outflow pressure differential is selected to be greater than a hydrostatic pressure experienced by the flow-through valve.

18. The pump-through standing valve of claim 1, wherein the standing valve comprises a single standing valve flow control device.

* * * * *